US007779759B2

(12) United States Patent
Paulic et al.

(10) Patent No.: US 7,779,759 B2
(45) Date of Patent: Aug. 24, 2010

(54) SUPERCAVITATING WATER-ENTRY PROJECTILE

(75) Inventors: Antonio Paulic, Manassas, VA (US); Alex Fu, Centreville, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 12/275,630

(22) Filed: Nov. 21, 2008

(65) Prior Publication Data

US 2010/0126372 A1 May 27, 2010

(51) Int. Cl.
*F42B 15/22* (2006.01)

(52) U.S. Cl. ..... 102/399; 114/20.1; 102/501

(58) Field of Classification Search ..... 102/399, 102/501; 114/20.1
See application file for complete search history.

(56) References Cited

U.S. PATENT DOCUMENTS

| | | | | | |
|---|---|---|---|---|---|
| 1,107,948 | A | | 8/1914 | Hoagland | |
| 1,384,841 | A | * | 7/1921 | Lundell | 102/398 |
| 2,103,155 | A | | 12/1937 | Foulke | |
| 3,041,992 | A | * | 7/1962 | Lee | 114/312 |
| 3,282,216 | A | | 11/1966 | Calfee et al. | |
| 3,434,425 | A | * | 3/1969 | Critcher | 102/399 |
| 3,568,956 | A | | 3/1971 | Swanson | |
| 3,915,092 | A | * | 10/1975 | Monson et al. | 102/399 |
| 4,674,706 | A | | 6/1987 | Hall | |
| 5,929,370 | A | * | 7/1999 | Brown et al. | 102/399 |
| 5,955,698 | A | * | 9/1999 | Harkins et al. | 102/399 |
| H1938 | H | | 2/2001 | Harkins et al. | |
| 6,405,653 | B1 | * | 6/2002 | Miskelly | 102/374 |
| 6,601,517 | B1 | | 8/2003 | Guirguis | |
| 6,684,801 | B1 | * | 2/2004 | Kuklinski | 114/67 A |
| 6,739,266 | B1 | * | 5/2004 | Castano et al. | 102/399 |
| 6,865,523 | B2 | | 3/2005 | Varghese et al. | |
| 7,118,072 | B2 | | 10/2006 | Kobayashi et al. | |
| 7,156,032 | B2 | | 1/2007 | Kornblit et al. | |
| 7,347,146 | B1 | * | 3/2008 | Gieseke | 102/399 |
| 2003/0019978 | A1 | | 1/2003 | Varghese et al. | |
| 2004/0107826 | A1 | * | 6/2004 | Simmons | 89/8 |
| 2007/0077044 | A1 | | 4/2007 | Kirschner et al. | |

* cited by examiner

*Primary Examiner*—J. Woodrow Eldred
*Assistant Examiner*—Gabriel J Klein
(74) *Attorney, Agent, or Firm*—Howard IP Law Group, PC

(57) ABSTRACT

A water-entry projectile capable of supercavitation and spin-stabilization comprises a forward section having one or more forward stepped sections, each stepped section being symmetrical in rotation about an axis and having a radius at an aft end that is different from a radius of a front end of an adjacent rearwardly located stepped section; an aft section having an aft stepped section, the aft stepped section being symmetrical in rotation about the axis and having a maximum radius larger than a maximum radius of the forward section; and wherein the aft section is located substantially aft of a center of gravity of the projectile.

16 Claims, 9 Drawing Sheets

SUPERCAVITATING WATER-ENTRY PROJECTILE

STATEMENT REGARDING FEDERALLY SPONSORED RESEARCH OR DEVELOPMENT

This invention was made with Government support under a Government contract No. N00014-07-C-0754. The Government has certain rights in this invention.

FIELD OF THE INVENTION

The present invention relates generally to munitions, and particularly to supercavitating munitions used in air-to-sea applications.

BACKGROUND

Underwater stability of supercavitating projectiles poses a significant challenge to the design of such vehicles. The challenge to designers becomes increasingly more difficult if the projectile not only requires the ability to maintain stability underwater but also through air. Prior art designs attempt to solve the stability problem by using projectile designs with large length-to-diameter ratios and/or by attaching fins or flairs to the aft end of the projectile. Alternative designs are desired.

SUMMARY OF THE INVENTION

In accordance with an embodiment of the invention, a water entry projectile capable of supercavitation and spin-stabilization has a low length-to-diameter ratio and includes a forward section having one or more forward stepped sections, each stepped section being symmetrical in rotation about an axis and having a radius at an aft end that is different from a radius of a front end of an adjacent rearwardly located stepped section. The projectile also has an aft section having an aft stepped section, the aft stepped section being symmetrical in rotation about the axis and having a maximum radius greater than a maximum radius of the forward section; and wherein the aft section is located substantially aft of a center of gravity of the projectile.

In one embodiment, a method of making a projectile comprises the steps of providing a projectile body, forming a forward section from the projectile body wherein the forward section has one or more forward stepped sections, each stepped section being symmetrical in rotation about an axis and having a radius at an aft end that is different from a radius of a front end of an adjacent rearwardly located stepped section. The method further comprises forming an aft section from said projectile body wherein said aft section has an aft stepped section, the aft stepped section being symmetrical in rotation about the axis and having a maximum radius larger than a maximum radius of said forward section. The projectile is formed such that the aft section is located substantially aft of a center of gravity of the projectile.

In another embodiment of the invention, a water entry projectile capable of supercavitation and spin-stabilization has a forward section having one or more forward stepped sections, each stepped section being symmetrical in rotation about an axis and having a diameter at an aft end that is different from a diameter of a front end of an adjacent rearwardly located stepped section, wherein at least one of the one or more forward stepped sections is drafted such that the diameter of the one or more stepped sections decreases inwardly towards the aft end of the projectile. The projectile also has an aft section having an aft stepped section, the aft stepped section being symmetrical in rotation about said axis and having a maximum radius larger than a maximum radius of said forward section, wherein the aft stepped section is drafted such that the radius of the aft stepped section increases outwardly towards the aft end of the projectile. The aft section is located substantially aft of a center of gravity of said projectile.

DETAILED DESCRIPTION

Reference will now be made in detail to the present exemplary embodiments of the invention, examples of which are illustrated in the accompanying drawings.

Figure 1A:
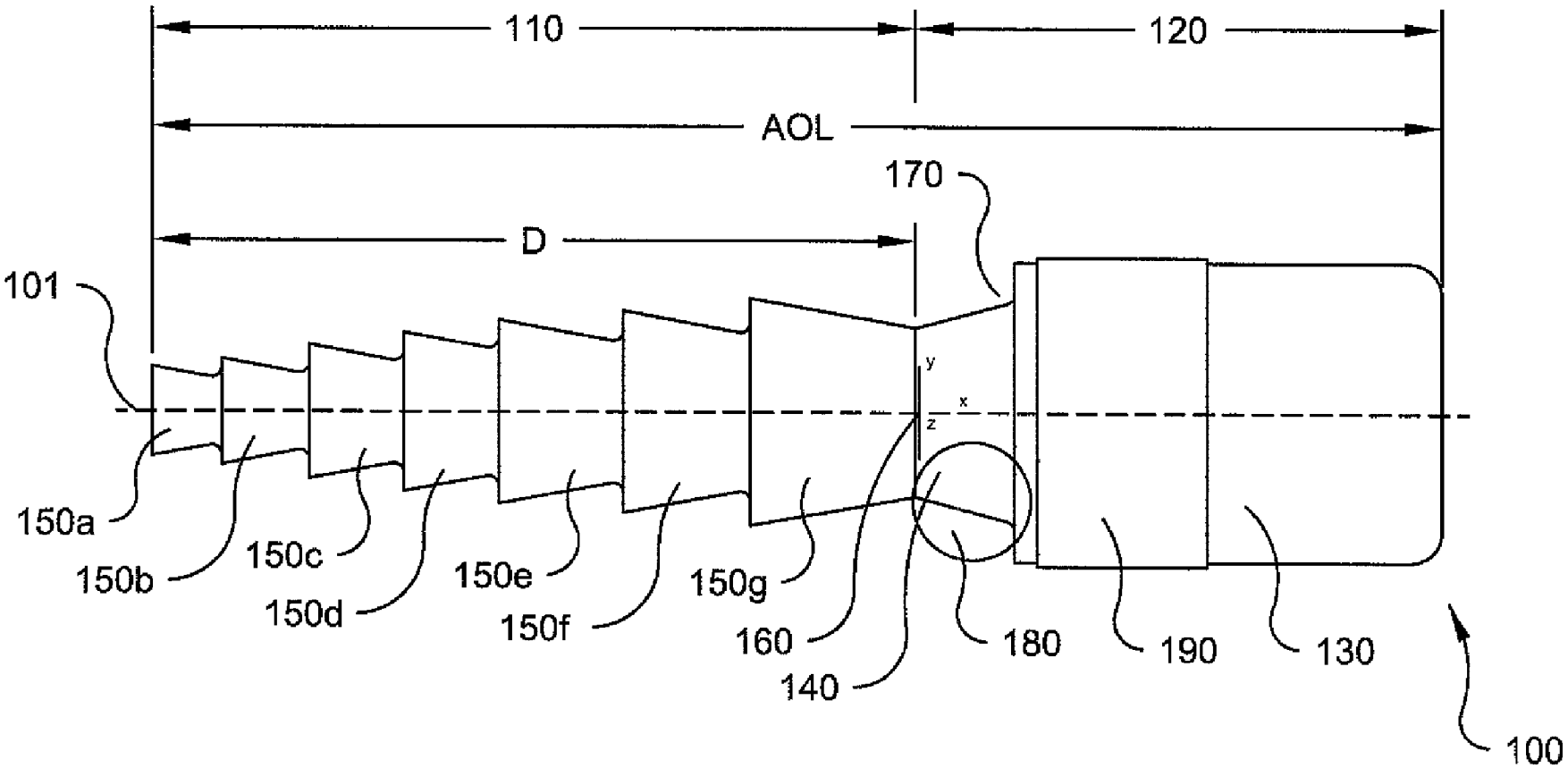
FIG. 1*a* is a diagram illustrating a side view of a projectile in accordance with an exemplary embodiment of the invention.
Figure 1B:
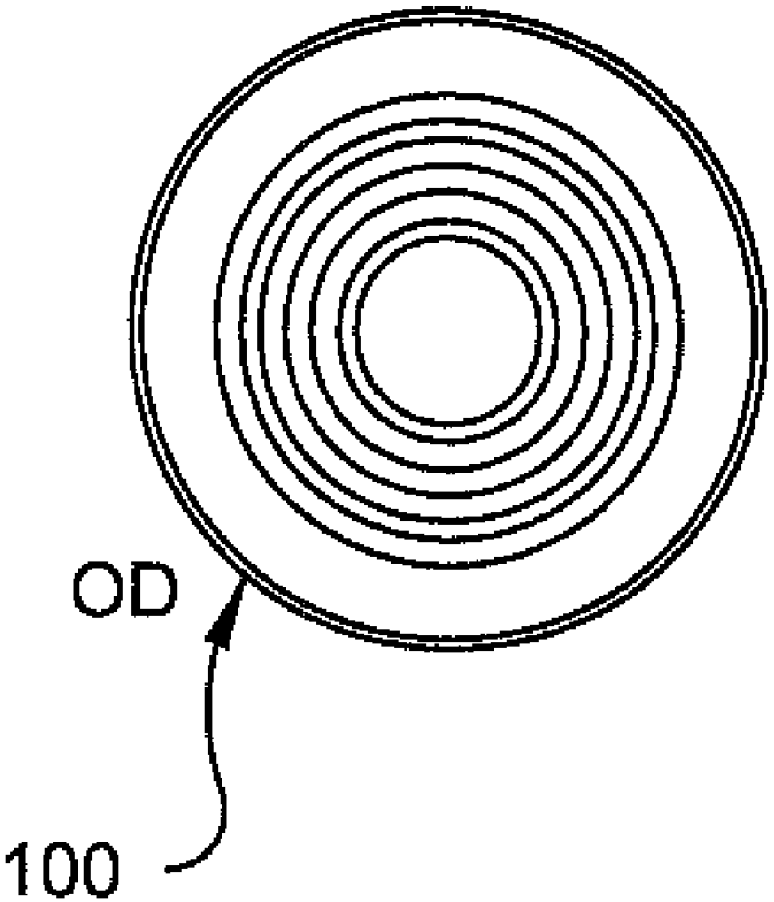
FIG. 1*b* is a top view of the projectile shown in FIG. 1*a*.

Referring to FIG. 1*a*-1*b*, there is shown a side view and top view, respectively, of a projectile 100 in accordance with an exemplary embodiment of the invention. The projectile 100 has a generally cylindrical body, symmetrical in rotation about an axis 101. The projectile comprises a forward section 110 located forward of the center of gravity (CG) 160, of the projectile. The forward section has a series (e.g. seven) of drafted stepped sections labeled as 150*a*, 150*b*, 150*c*, 150*d*, 150*e*, 150*f*, and 150*g*. The drafted steps 150*a*-*g* of the exemplary embodiment have a maximum outer diameter that is smaller than the minimum outer diameter of any rearwardly located step. It is noted however that each step may have a diameter of varying size. The projectile 100 further comprises an aft section 120 located aft of the CG 160. The aft section 120 comprises an additional drafted step 140 located aft or rearward of the first series of steps. The aft section 120 comprises a main body 130 having an outer diameter larger than section 140 and a forward face 170 that is integrally coupled to drafted step 140 forming an area of impingement labeled as 180. The main body 130 of the projectile 100 also has an obturator band 190 which extends radially outward from the surface of the main body 130. The obturator band 190 allows the projectile to be fired from rifled artillery and therefore makes the projectile capable of spin stabilization. The forward stepped sections 150*a*-*g* serve to increase the water impingement on area 180 while the projectile's forward section contacts the water cavity as it supercavitates through water. The increased water impingement on the area of impingement 180 located aft of the CG, will cause the projectile to experience a restoring torque high enough to counter yaw instability (up to about 10 degrees) that may occur as the projectile travels through water. This restoring torque not only provides the projectile with underwater yaw angle stability but also improves the range of stability of the projectile as compared with previous large length-to-diameter ratio designs (previous designs, having a length-to-diameter ratio of 10:1 or more, only provide yaw stability up to approximately 1-2 degrees). This overcomes the problem of generation of an adequate restoring torque in the absence of features of previous designs such as the finned or flared aft ends that serve to provide some underwater stability. It is noted that the exemplary projectile 100 of FIG. 1*a* does not include either a finned or flared element. Thus a more stable supercavitating projectile is contemplated with minimal if any tradeoff in air travel performance.

Figure 2A:
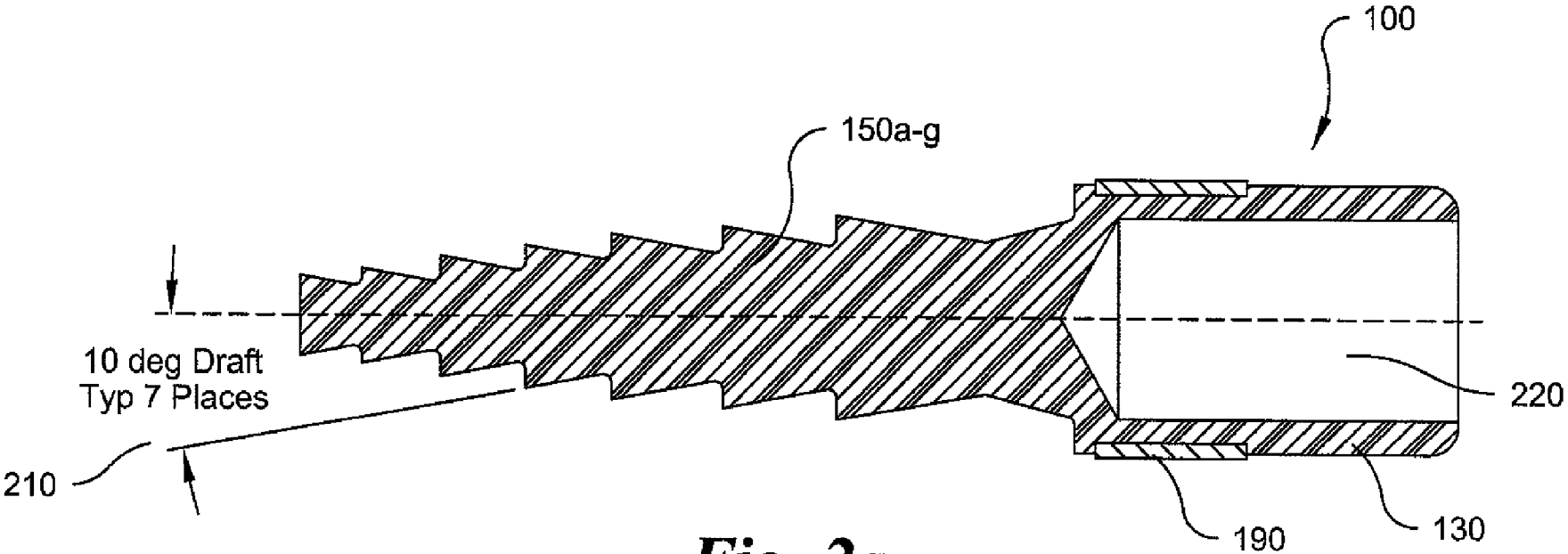
FIG. 2*a* is a diagram illustrating a section view of the exemplary projectile of FIG. 1*a*.
Figure 2B:
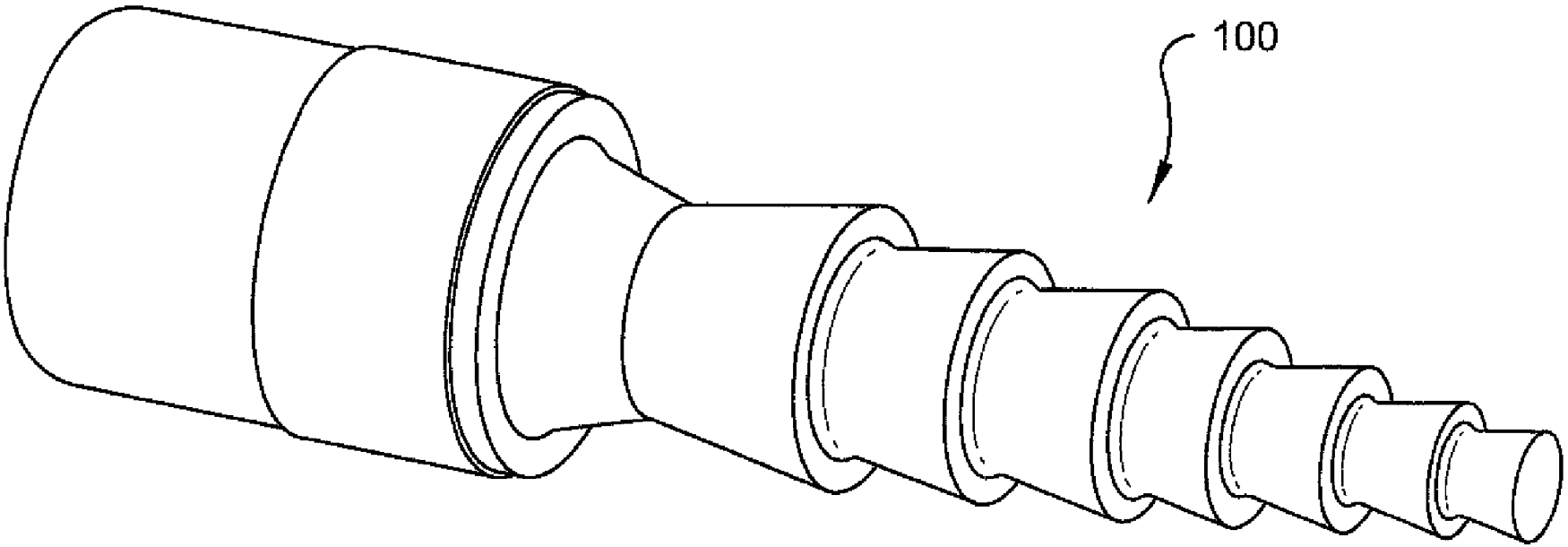
FIG. 2*b* is a diagram illustrating an isometric view of the exemplary projectile of FIG. 1*a*.

Referring now to FIG. 2*a*, a section view of the projectile 100 of FIG. 1*a* is provided. Each drafted step 150*a-g* has a draft angle 210 that causes the diameter of the step to decrease inwardly towards the aft end of the projectile. In the exemplary embodiment, the draft angle 210 of each drafted step is shown to be approximately 10 degrees, however it is noted that the geometry of each drafted section may vary in angle, curvature or taper. This drafted section serves to reduce the exposed step area normal to the projectile direction of travel. More specifically, this prevents water impingement on the sidewalls of the steps for all yaw angles up to the draft angle thereby significantly reducing a destabilizing torque on the projectile.

Figure 3:
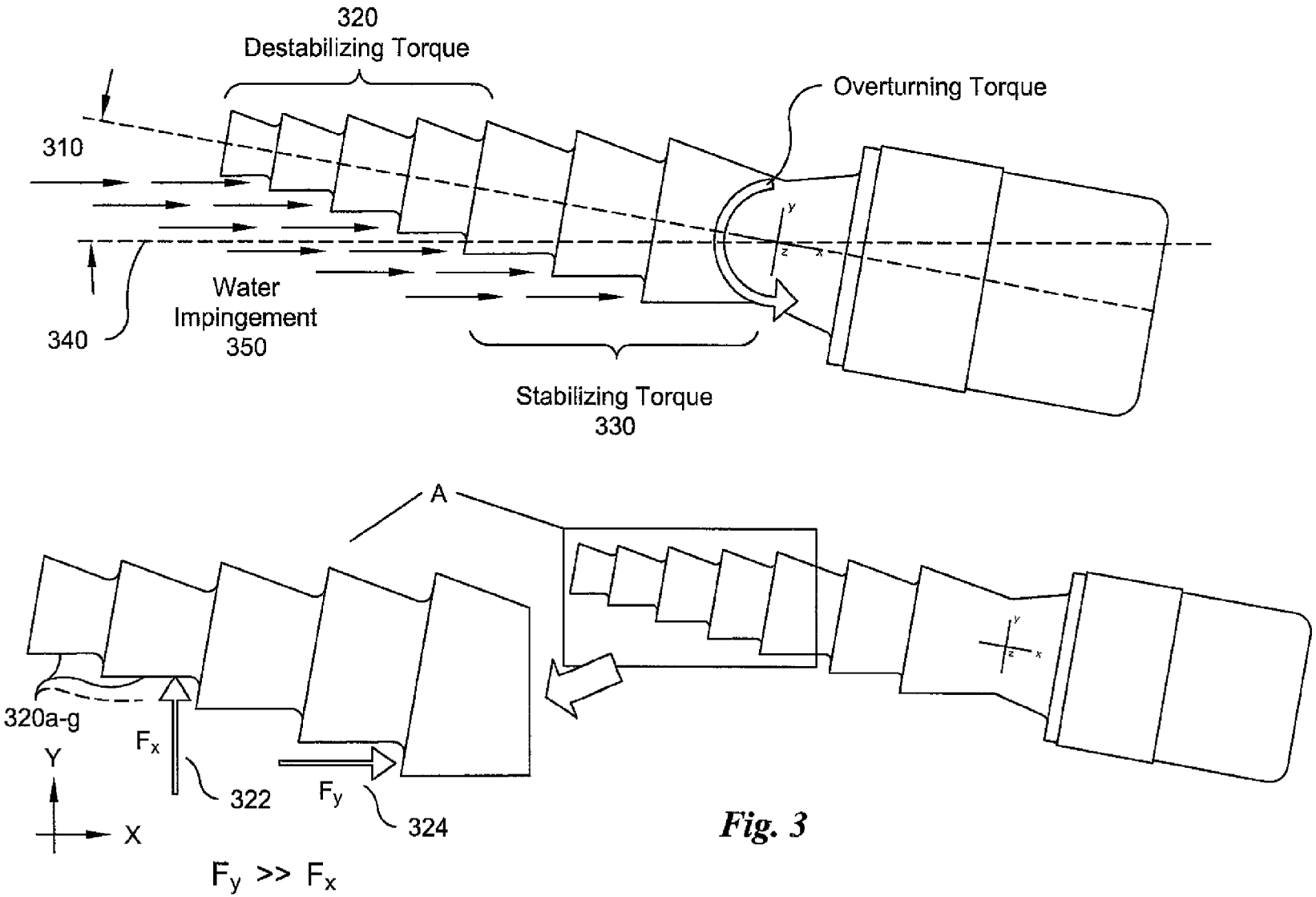
FIG. 3 is a diagram illustrating water impingement on the forward section of the exemplary projectile of FIG. 1*a*.

Referring now to FIG. 3, an illustration of the exemplary projectile 100 of FIG. 1*a* is shown traveling through water where the yaw angle 210 and the draft angle 310 are substantially equal. This results in a scenario where the water impingement 350 is parallel to the sidewalls 320*a-g* of the drafted steps thus avoiding any torque destabilizing water impingement on the sidewalls 320*a-g* of the projectile. A breakdown of the forces, Fx 322 and Fy 324, acting on the projectile as a result of water impingement is shown in breakout section A. The drafted steps allow the forces to be distributed such that at yaw angles below the draft angle the force Fy 322 that acts on the front face of each step will be significantly greater than the force Fx that acts on the sidewall of the step. The forces Fy 324 that act on drafted steps which yaw above the CG (steps 150*a-d*), will cause a destabilizing torque 320 on the projectile 300. However, this destabilizing torque is significantly reduced in comparison to projectiles without such drafted steps. Furthermore, the forces Fy 324 that act on drafted steps which remain below the CG (steps 150*e-g*), will impart a stabilizing torque 330 on the projectile 300. As a result, a net increase in stabilizing torque is seen by projectile 300 in comparison to a projectile without such drafted steps. It is further understood that the structural features associated with the projectile of the present invention, in particular, its relative length and width, further enhances the structural integrity of the body such that the effective load on the body as a function of increasing yaw angle does not result in a structural failure or fracture of the body.

Referring back to FIG. 1*a* the aft section 120 of the exemplary projectile 100 comprises an additional drafted step 140 located aft or rearward of forward stepped sections 150*a-g*. The additional drafted step 140 has a draft angle that causes the diameter of the step to increase outwardly towards the aft end of the projectile. As discussed, the drafted steps located forward of the center of gravity reduce the exposed step areas normal to the direction of travel of the projectile up to the draft angle 210. However, the forward drafted steps also serve to increase the water impingement on the drafted step 140 located aft of the center of gravity of the projectile by allowing the water to flow unimpeded by the drafted steps and impinge on the drafted step 140 aft of the center of gravity.

Figure 4:
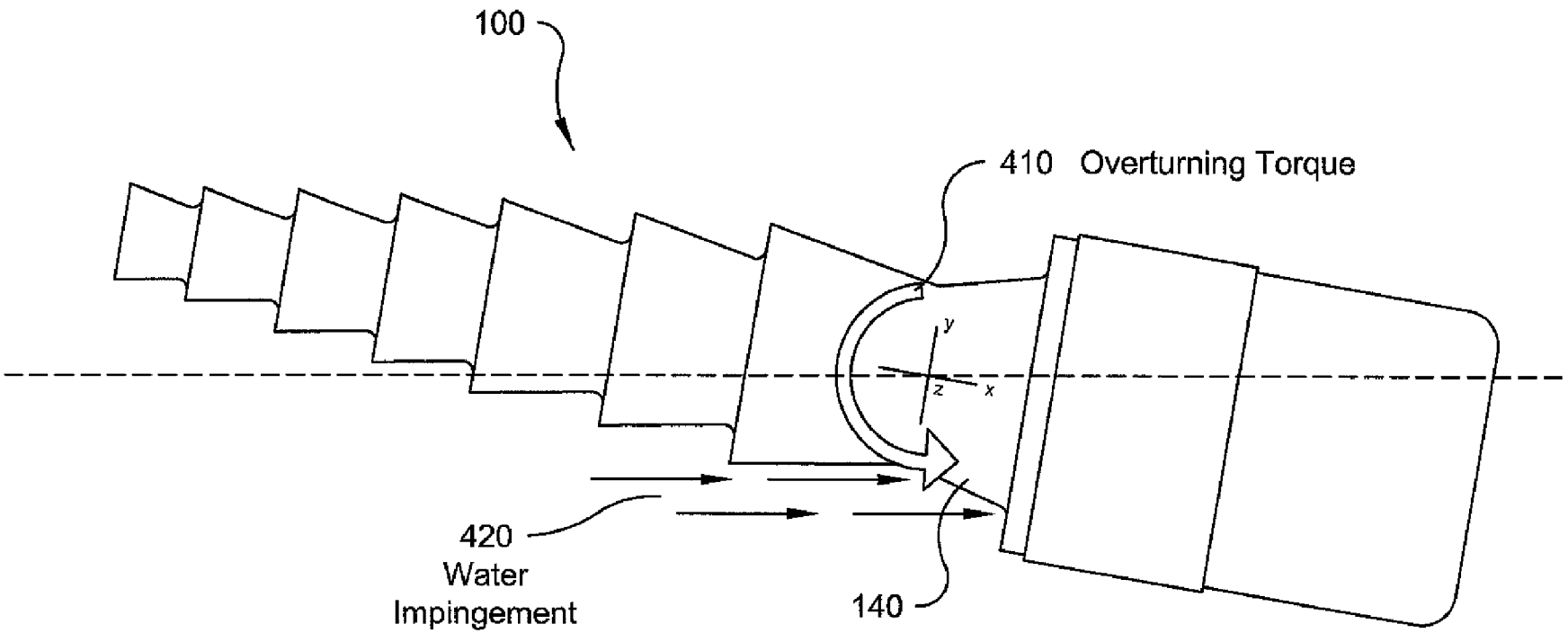
FIG. 4 is a diagram illustrating water impingement on the aft section of the exemplary projectile of FIG. 1*a*.

Referring now to FIG. 4, this water impingement 420 that acts on the drafted step 140 is shown along with the resulting desired overturning torque 410. Both the draft angle of the step 140 and the increased water impingement on the step contribute to increasing the net stabilizing torque on the projectile 100. This increases the overall stable yaw angle range of the projectile and improves the restoring torque load at lower yaw angles.

Referring back to FIGS. 2*a* and 2*b* there is provided a section view and isometric view, respectively, of the projectile 100 of FIG. 1*a*. The main body 130 and stepped sections 150*a-g* of the projectile 100 are comprised of tungsten or similar high impact strength S7 tool steel material. The obturator band 190 is comprised of brass or similar material suitable for rifling. As best shown in FIG. 2*a*, a cavity 220 within main body 130 carries the payload of the projectile 100. With reference to FIGS. 1*a*-1*b*, 2*a*-2*b*, and by way of example only, projectile 100 may have a mass of approximately 1.17 lbm, an overall length AOL of approximately 5.13 inches and an outer diameter (OD) of approximately 1.18 inches. In the exemplary embodiment, the center of gravity is located approximately a distance D of 3.05 inches measured from the forward face of the projectile 100.

Figure 5A:
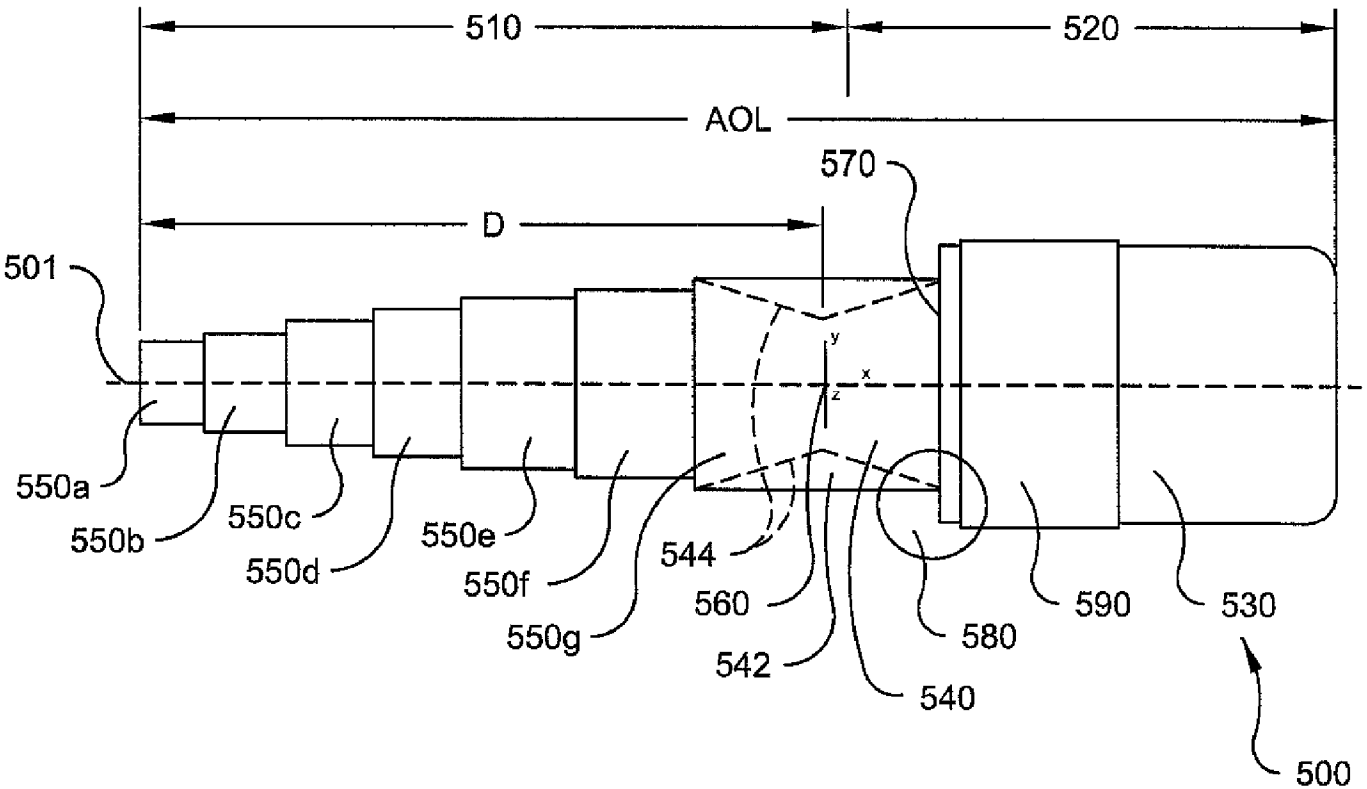
FIGS. 5*a*-5*b* illustrate side and top views, respectively, of a projectile in accordance with another exemplary embodiment of the invention.
Figure 5B:
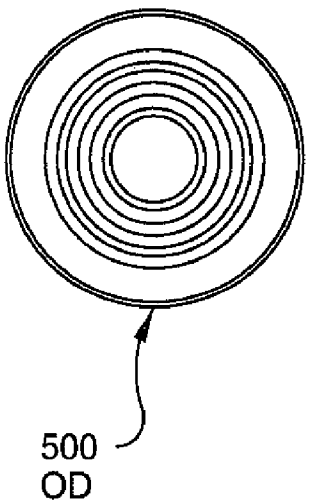

Referring now to FIG. 5*a*-5*b*, a side view and top view, respectively, of a projectile 500 is shown in accordance with another exemplary embodiment of the invention. The projectile 500 has a generally cylindrical body, symmetrical in rotation about an axis 501. The projectile comprises a forward section 510 located forward of the center of gravity (CG) 560, the forward section having a series (e.g. seven) of stepped sections labeled as 550*a*, 550*b*, 550*c*, 550*d*, 550*e*, 550*f*, and 550*g*. Each step 550*a-g* has an outer diameter that is smaller than the outer diameter of any rearwardly located step. It is noted that while in the exemplary embodiment seven stepped sections are shown, any number of steps may be used. The projectile 500 further comprises an aft section 520 located aft of the CG 560. The aft section 520 comprises an additional section 540 located aft or rearward of the first series of steps 550*a-g* that attaches to a main body 530 having an outer diameter larger than section 540 and a forward face 570 that is integrally coupled to section 540 forming an area of impingement labeled as 580. The main body 530 of the projectile 500 also has an obturator band 590 which extends radially outward from the surface of the main body 530 thereby allowing the projectile to be fired from rifled artillery. The forward stepped sections 550*a-g* serve to increase the water impingement on area of impingement 580. The increased water impingement on the area of impingement 580 located aft of the CG, will cause the projectile to experience a restoring torque high enough to counter yaw instability (up to about 8 degrees) that may occur as the projectile travels through water. While projectile 500 does not provide as large a range of yaw angle stability as the projectile 100 of FIG. 1*a*, it does improve the range of stability as compared with previous large length-to-diameter ratio designs (previous designs only provide yaw stability up to approximately 1-2 degrees). This overcomes the problem of generation of an adequate restoring torque in the absence of features of previous designs such as the finned or flared aft ends that serve to provide some underwater stability.

Projectile 500 may alternatively include a cutout section 542 defined by dashed lines 544. Material is removed from the projectile 500 to form the cutout section 542 in such a way as to establish a forward tapered section having a rearwardly decreasing diameter and an aft tapered section having a rearwardly increasing diameter. The change in taper direction occurs at approximately the center of gravity 560 of the projectile 500. The forward tapered section serves to reduce water impingement normal to the direction of travel in turn causing increased water impingement on the aft end of the cutout section 542. This results in an increase in net restoring torque load on the projectile 500.

Figure 6A:
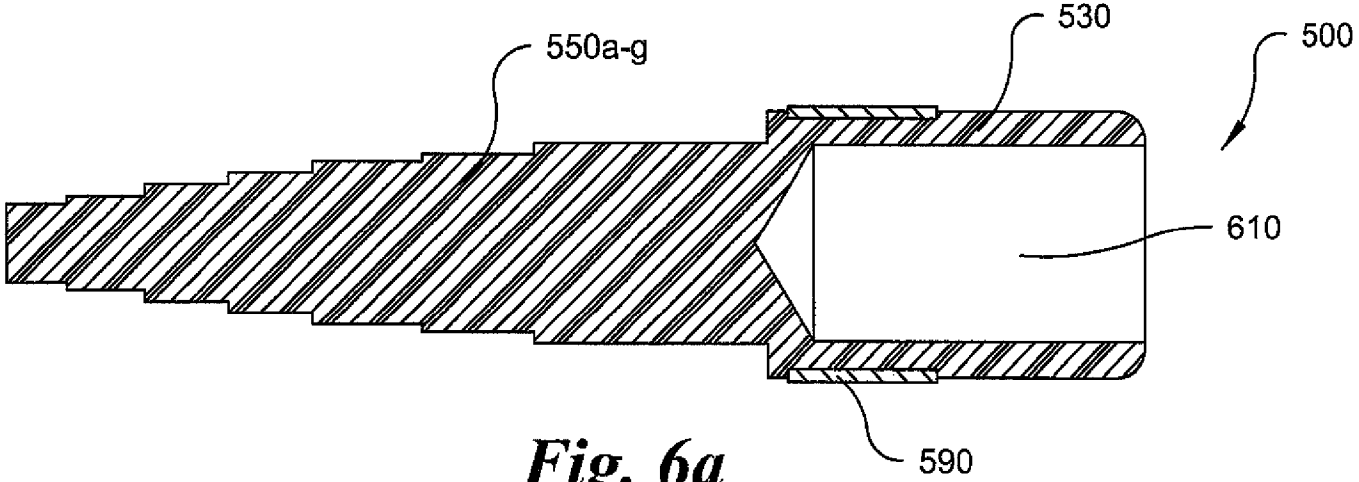
FIG. 6*a* is a diagram illustrating a section view of the exemplary projectile of FIG. 5*a*.
Figure 6B:
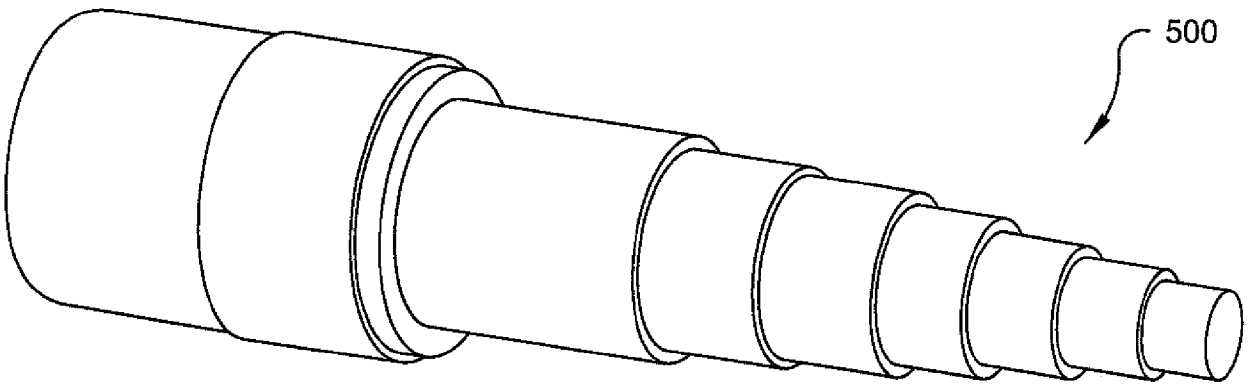
FIG. 6*b* is a diagram illustrating an isometric view of the exemplary projectile of FIG. 5*a*.

Referring now to FIGS. 6*a* and 6*b* in conjunction with FIG. 5*a*, there is provided a section view and isometric view, respectively, of the projectile 500 of FIG. 5. The main body 530 and stepped sections 550*a-g* of the projectile 500 are comprised of tungsten or similar high impact strength S7 tool steel material. The obturator band 590 is comprised of brass or similar material suitable for rifling. Also shown in FIG. 6*a* is a cavity 610 which carries the payload of the projectile 500. By way of example only, projectile 500 may have a mass of approximately 1.37 lbm, an overall length AOL of approximately 5.13 inches and an outer diameter (OD) of approximately 1.18 inches. The center of gravity is located a distance D of approximately 2.94 inches measured from the forward face of the projectile 500.

Figure 7:
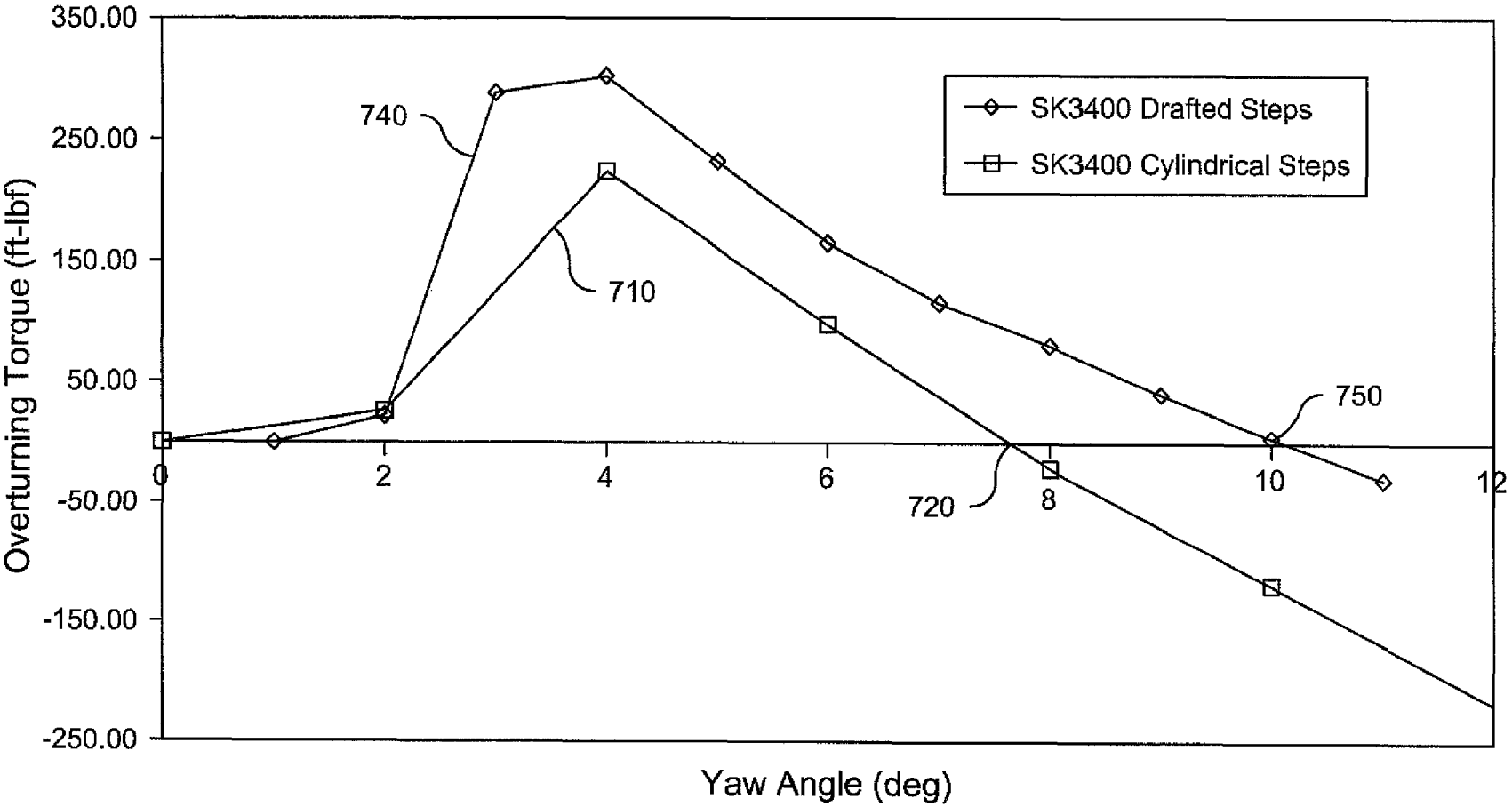
FIG. 7 is a chart illustrating the overturning torque vs. yaw of the exemplary projectiles of FIGS. 1 and 5.

Referring now to FIG. 7, a graph created from a computational fluid dynamic model is shown to illustrate improvements in overturning torque that result from aspects of the exemplary embodiments of the invention. Line 740 illustrates the overturning torque vs. yaw angle as experienced by exemplary projectile 100. Line 710 illustrates the overturning torque vs. yaw angle as experienced by exemplary projectile 500. On the graph a positive overturning torque value represents a net stabilizing torque whereas a negative overturning torque represents net destabilizing torque. As can be seen both exemplary projectiles can withstand high maximum yaw angles (between 7-10 degrees) before they begin to experience a destabilizing torque. Exemplary projectile 500 has an upper threshold yaw angle labeled as 720 at approximately 7-8 degrees whereas exemplary projectile 100 has an upper threshold yaw angle labeled as 750 at approximately 10 degrees. Exemplary projectile 100 achieves a higher threshold as a result of the previously discussed drafted step features. It is noted that this upper threshold is in no way limited to 10 degrees. Choosing a larger draft angle will result in a higher stable yaw threshold.

Thus, a low length-to-diameter projectile suitable for spin-stabilized travel through air as well as stable supercavitating travel through water has been described by means of example and not limitation. A low length-to-diameter projectile is contemplated that has a forward section having one or more stepped sections located forward of the center of gravity (CG), as well as an aft section with an aft stepped section located aft of the CG. The overall stable yaw angle range of the supercavitating projectile is increased along with the restoring torque load at lower yaw angles. The exemplary projectile 100 shown in FIG. 1*a* also possesses improved ballistic performance while traveling in air as compared with the exemplary projectile 500 shown in FIG. 5. This improvement results from the center of gravity of the projectile 500 being shifted further aft as a result of the removal of additional material to form the drafted steps.

While the foregoing invention has been described with reference to the above-described embodiments, various modifications and changes can be made without departing from the spirit of the invention. Accordingly, all such modifications and changes are considered to be within the scope of the appended claims.

What is claimed is:

1. A water-entry projectile capable of supercavitation and spin-stabilization comprising:

a forward section having a plurality of forward stepped sections, each stepped section being symmetrical in rotation about an axis and having a diameter at an aft end that is different from a diameter of a front end of an adjacent rearwardly located stepped section;

an aft section having a main body and an aft stepped section, said aft section being symmetrical in rotation about said axis, and said main body having a maximum diameter larger than a maximum diameter of said forward section, the aft stepped section connected between the main body and the forward section and having a front end connected to the aft end of the most rearwardly located forward stepped section, the diameter at the front end of the aft stepped section being equal to the diameter of the aft end of the most rearwardly located forward stepped section; and wherein said aft section is located substantially aft of a center of gravity of said projectile.

2. The projectile of claim 1, wherein each of said plurality of forward stepped sections is substantially cylindrical in shape.

3. The projectile of claim 1, wherein at least one of said plurality of forward stepped sections is drafted such that the diameter of said plurality of stepped sections decreases inwardly towards the aft end of the projectile.

4. The projectile of claim 1, wherein said aft stepped section is drafted such that the diameter of the aft stepped section increases outwardly towards the aft end of the projectile.

5. The projectile of claim 3, wherein said aft stepped section is drafted such that the diameter of the aft stepped section increases outwardly continuously towards the aft end of the projectile; and wherein at least one of said plurality of forward stepped sections is adapted to increase water impingement on said aft stepped section.

6. The projectile of claim 1, wherein said aft section further comprises an obturator band extending radially outward from said aft section.

7. A method of making a water-entry projectile capable of supercavitation and spin-stabilization comprising:

providing a projectile body;

forming a forward section from said projectile body wherein said forward section has a plurality of forward stepped sections, each stepped section being symmetrical in rotation about an axis and having a diameter at an aft end that is different from a diameter of a front end of an adjacent rearwardly located stepped section;

forming an aft section from said projectile body wherein said aft section has an aft stepped section whose front end is connected to the aft end of the most rearwardly located forward stepped section, the front end of the aft stepped section and the aft end of the most rearwardly located forward stepped section having equal diameters, said aft section being symmetrical in rotation about said axis and having a maximum diameter larger than a maximum diameter of said forward section; and wherein said projectile is formed such that said aft section is located substantially aft of a center of gravity of said projectile.

8. The method of claim 7, wherein said step of forming said forward section further comprises forming each of said plurality of forward stepped sections to be substantially cylindrical in shape.

9. The method of claim 7, wherein said step of forming said forward section further comprises drafting at least one of said plurality of forward stepped sections such that the diameter of said plurality of stepped sections decreases inwardly towards the aft end of the projectile.

10. The method of claim 7, wherein said step of forming said aft section further comprises drafting said aft stepped section such that the diameter of the aft stepped section increases outwardly towards the aft end of the projectile.

11. The method of claim 9, wherein said step of forming said aft section further comprises drafting said aft stepped section such that the diameter of the aft stepped section increases continuously outwardly towards the aft end of the projectile; and wherein at least one of said plurality of forward stepped sections is adapted to increase water impingement on said aft stepped section.

12. A water-entry projectile capable of supercavitation and spin-stabilization comprising:

a forward section having a plurality of forward stepped sections, each stepped section being symmetrical in rotation about an axis and having a diameter at an aft end that is different from a diameter of a front end of an adjacent rearwardly located stepped section, wherein at least one of said plurality of forward stepped sections is drafted such that the diameter of said one or more stepped sections decreases inwardly towards the aft end of the projectile;

an aft section having an aft stepped section with a front end connected to the aft end of the most rearwardly located forward stepped section, said aft section being symmetrical in rotation about said axis and having a main body aft of said aft stepped section and having a maximum radius larger than a maximum radius of said forward section, wherein said aft stepped section is drafted such that the radius of the aft stepped section increases outwardly towards the aft end of the projectile; and wherein said front end of said aft stepped section is located substantially at a center of gravity of said projectile.

13. The projectile of claim 12, wherein said aft section main body further comprises an obturator band extending radially outward from said aft section.

14. The projectile of claim 1, where the aft section main body is substantially cylindrical in shape.

15. The projectile of claim 14, wherein the aft section does not include a flared or finned element.

16. The projectile of claim 1, wherein the projectile is adapted to be fired from a rifled barrel.

* * * * *